United States Patent [19]

Navratil

[11] Patent Number: 4,694,896

[45] Date of Patent: Sep. 22, 1987

[54] HEAT EXCHANGER

[76] Inventor: Frank Navratil, 14-90 Langside Street, Winnipeg, Manitoba, Canada, R3C 1Z2

[21] Appl. No.: 921,483

[22] Filed: Oct. 22, 1986

[30] Foreign Application Priority Data

Nov. 5, 1985 [CA] Canada ..... 494582

[51] Int. Cl.[4] ..... F28D 7/12

[52] U.S. Cl. ..... 165/142; 165/160

[58] Field of Search ..... 165/142, 160, 183

[56] References Cited

U.S. PATENT DOCUMENTS

| | | | |
|---|---|---|---|
| 79,931 | 7/1868 | Agate | 165/160 |
| 1,355,980 | 10/1920 | Jones | 165/160 |
| 1,571,889 | 2/1926 | Ripley | 165/161 |
| 1,683,236 | 9/1928 | Braun | 165/160 |
| 1,768,786 | 7/1930 | Potter | 165/161 |
| 1,848,197 | 3/1932 | Ray et al. | 165/161 |
| 3,134,432 | 5/1964 | Means | 165/161 |
| 3,749,160 | 7/1973 | Vestre | 165/160 |
| 3,776,302 | 12/1973 | Waszink et al. | 165/160 X |
| 4,147,209 | 4/1979 | Persson | 165/161 |
| 4,204,573 | 5/1980 | Clark | 165/142 |
| 4,215,743 | 8/1980 | Margittai | 165/141 |
| 4,415,024 | 11/1983 | Baker | 165/160 |
| 4,548,257 | 10/1985 | Williamson | 165/142 X |

FOREIGN PATENT DOCUMENTS

| | | | |
|---|---|---|---|
| 534470 | of 0000 | Canada | 165/160 |
| 393792 | 1/1941 | Canada | 165/161 |
| 436391 | 8/1946 | Canada | 165/161 |
| 870921 | 5/1971 | Canada | 165/160 |
| 1093547 | 1/1981 | Canada | 165/160 |
| 2403713 | 1/1974 | Fed. Rep. of Germany | 165/142 |

*Primary Examiner*—Albert W. Davis, Jr.
*Assistant Examiner*—Peggy Neils
*Attorney, Agent, or Firm*—Adrian D. Battison; Stanley G. Ade

[57] ABSTRACT

A heat exchanger preferably of the type for heating water from hot gases or steam comprises first and second tubes arranged concentrically so as to define a channel inside the first tube, an annular channel between the tubes and a further channel outside the outer tube. The hot gases are arranged to pass inside the inner tube and outside the outer tubes so that water passing through the annular channel is heated from both the inner and outer surfaces. Such an arrangement can be built up into a total heat exchanger by an array of such co-axial tubes arranged side by side or by an array of such co-axial tubes arranged co-axially, that is with further tubes outside the outer tube. Baffles in the form of radial fins cause the fluid to move along an underside of the baffle toward a closed end and then to turn at the closed end back along an upper side of the baffles toward the outlet.

9 Claims, 6 Drawing Figures

HEAT EXCHANGER

BACKGROUND OF THE INVENTION

This invention relates to a heat exchange for exchanging heat between first and second fluids.

Generally, heat exchangers of this type include an inlet and an outlet for each of the fluids and a core within a housing through which the fluids pass in heat exchanging, fluid impervious relationship.

Much attention has been given to the development of heat exchange cores for solving various problems associated with heat exchangers of various different types.

SUMMARY OF THE INVENTION

The present invention is particularly concerned with the development of a core which has particularly high heat transfer capability in order to ensure that as much heat as possible is extracted from one fluid for communication to the second fluid, particularly although not exclusively in relation to heating cold water from steam or other gases, for example flue gases.

It is one object of the present invention, therefore, to provide an improved heat exchanger which can give increased heat transfer between fluids on an increased heat transfer surface.

According to the first aspect of the invention, therefore, there is provided a heat exchanger for exchanging heat between a first fluid and a second fluid, comprising a housing, means defining in said housing a first inlet and a first outlet for the first fluid and a second inlet and a second outlet for the second fluid, an heat exchange core through which said fluids are arranged to pass in heat exchanging, fluid impervious relationship, said core comprising a plurality of first tubes, a plurality of second tubes, means mounting each of the first tubes inside a respective one of the second tubes and arranged so as to define for each first and second tube a first channel through said first tube having as an outer surface the inner surface of said first tube, a second channel having as an outer surface the inner surface of the second tube and as an inner surface the outer surface of the first tube and a third channel having as an inner surface the outer surface of the second tube, first manifold means for communicating said first fluid from said first inlet through said first and third channels to said first outlet and second manifold means for communicating said second fluid from said second inlet through said second channel to said second outlet.

According to a second aspect of the invention, therefore, there is provided a heat exchanger for exchanging heat between the first fluid and the second fluid comprising a housing, means defining in said housing a first inlet and a first outlet for the first fluid and a second inlet and a second outlet for the second fluid, an heat exchange core through which said fluids are arranged to pass in heat exchanging, fluid impervious relationship, said core comprising a first tube sheet, a plurality of first tubes attached in spaced arrangement thereon and extending outwardly to one side of said first tube sheet, a second tube sheet, a plurality of second tubes attached in spaced arrangement thereon and extending outwardly to one side of said second tube sheet, means mounting said first and second tube sheets in spaced relation and arranged such that each of said first tubes extends into a respective one of the second tubes, a first manifold means arranged on an opposed side of said first tube sheet whereby to communicate fluid from said first inlet through said first tubes, and second manifold means arranged on said one side of said first tube sheet and on an opposed side of said second tube sheet whereby to communicate fluid from said second inlet through an annular space defined between said second tubes and said first tubes.

According to a third aspect of the invention there is provided a heat exchanger for exchanging heat between the first fluid and the second fluid, comprising a housing, means defining in said housing a first outlet and a first inlet for the first fluid and the second inlet and the second outlet for the second fluid, an heat exchange core through which said fluids are arranged to pass in heat exchanging, fluid impervious relationship, said core comprising a plurality of tubes arranged coaxially with each inside the next adjacent from an outermost tube to an innermost tube so as to define a plurality of annular channels between the tubes with the innermost tube defining a cylindrical channel theretrough, first manifold means arranged at respectivbe ends of said tubes for communicating said first fluid from said inlet through alternate ones of said annular channels too said outlet and second manifold means arranged radially of said tubes from said second outlet to said second inlet and arranged for communicating said second fluid into and out of the annular channels alternate to those communicating with the first manifold means.

One embodiment of the invention, therefore, has the advantage that the first fluid can pass heat to the second fluid both from a surface inside and a surface outside the second fluid channel. This acts to increase or maximize the amount of surface available for communicating heat and thus can improve the heat transfer.

In addition, the embodiment of the invention provide improved structures of heat transfer surface particularly using tubes which are arranged co-axially one inside the other to define the improved heat exchange surfaces.

With the foregoing in view, and other advantages as will becom apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE INVENTION

In the drawings like characters of reference indicate corresponding parts in the different figures.

DETAILED DESCRIPTION

Figure 1:
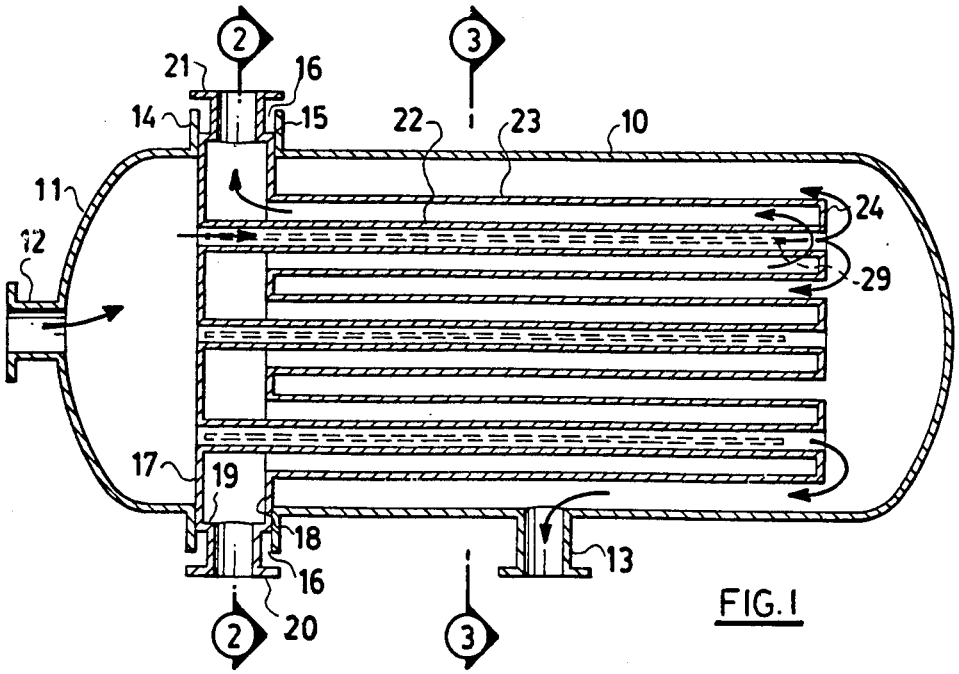
FIG. 1 is a longitudinal cross sectional view of a heat exchanger according to the invention.
Figure 2:
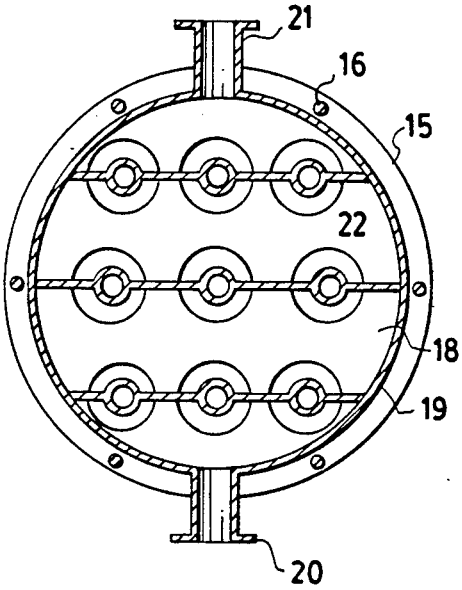
FIG. 2 is a cross sectional view along the lines 2—2 of FIG. 1.
Figure 3:
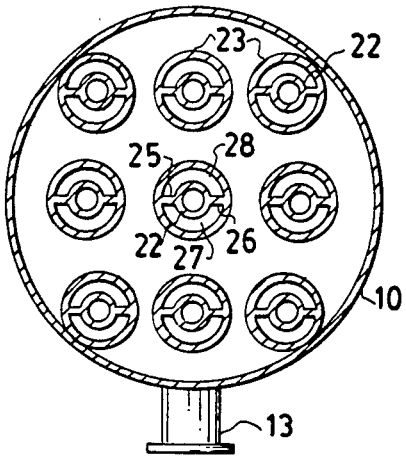
FIG. 3 is a cross sectional view along the lines 3—3 of FIG. 1.

Turning first to the embodiment of FIGS. 1, 2 and 3 there is provided a heat exchanger including an outer housing defined by a cylindrical shell 10 which cooperates with an end cap 11 to create effectively a cylindrical body within which heat exchange takes place. The end cap 11 includes a first fluid inlet 12 through which hot gas or steam can be supplied and the cylindrical body 10 includes a fluid ontlet 13 from which the hot gas or sream Bscapes, with the outlet 13 being positioned at the bottom of the housing so as to receive any condensate.

The end cap 11 includes a surrounding flange 14 and similarly, the cylindrical body 10 includes a surrounding flange 15 with the flanges 14 and 15 being bolted together by bolts 16 so as to complete dthe cylindrical body.

A heat exchange core comprises a first tube sheet 17 and a second tube sheet 18 which are held in spaced relation by a surrounding collar 19. The tube sheets are clamped together so that the sheets and the collar form an enclosed chamber clamped together by the flanges 14 and 15. An inlet 20 is provided in the collar 19 so as to communicate with the chambeer formed within the collar 19 and similarly an outlet 21 is positioned at an opposed position in the collar as shown best in FIG. 2.

The first tube sheet 17 carries a plurality of first tubes 22 which extend outwardly from one face of the tube sheet through the chamber defined by the collar 19 and into the cylindrical housing 10. The tubes 22 are welded dto the tube sheet so as to be supported thereby and so as to form a seal therewith. The second tube sheet 18 carries a second plurality of tubes 23 in a similar array to that of the tubes 22 so that each of the tubes 22 extends into a corresponding one of the tubes 23 and is positioned therein in co-axial relationship so as to define an annular passage or channel therebetween.

The annular channel between the tubes 22 and 23 is closed by an end closure member 24 at the coterminous ends of the tubes 22 and 23 opposite the tube sheets 17 and 18. It will be noted that the ends of the tubes and thus the enclosure member 24 are arranged adjacent the curved closed end of the cylindrical housing 10 so the tubes extend substantially wholly along the housing 10.

Each tube 22 within a corresponding tube 23 carries a pair of radial fins 25, 26 which extend therealong from the tube sheet 17 to a position closely adjacent the end closure member 24. The radial dimension of the fins is such that the fins are sliding fit within the tube 23 and thus divide the annular channel defined by the tubes into an upper and lower chamber as shown best in FIG. 3, with the lower chamber indicated at 27 and the upper chamber at 28. The positon of termination of the radial fins is shown best in FIG. 1 and is indicated at 29 which is spaced from the end closure member 24 thus defining a channel between the upper and lower chambers 27, 28. The fins 25, 26 are welded to the tube 22 and extend on opposed sides thereof in substantially the horizontal plane.

Within the chamber defined by the collar 19, as best shown in FIG. 2, the radial fins are increased in dimension from the diameter of the tubes 23 to a size such that they cooperate with one another and with the collar 19 to divide the chamber into four separate sections as shown in FIG. 2. Thus, all fluid entering the inlet 20 is obliged to pass into the lower portion 27 of the annular channels of the three lowermost tubes. The fluid then turns adjacent the end closure member 24 to return along the upper portion of the lowermost tubes to enter the seciton portion of thee chamber defined by the collar 19. Thus, as will be apparent from the fluid flow arrows indicated in FIG. 1, the fluid passes through each of the levels of tubes in turn before reaching the outlet 21.

Thus, the chamber is defined by the collar 19 provides a manifold for the second fluid and communicates that fluid through the tubes as explained form the inlet 20 to the outlet 21.

The end cap 11 effectively defines a second manifold so that fluid entering the inlet 12 encounters the opposite face of the tube sheet 17 and thus is obliged to enter the interior of the tubes 22 for communication along the tubes 22 into the housing 10. The fluid exiting from the tubes 22 thus is turned by the housing to pass along the outer surfaces of the tubes 23 toward the outlet 13.

In this way, the first fluid passing through the inner surface of the tubes 2 can communicate heat through the tube 22 into the fluid in the annular chamber and at the same time the first fluid exiting from the interior of the tubes 22 can communcate heat through the outer surface of the tubes 23 to the fluid in the annular chamber.

Figure 4:
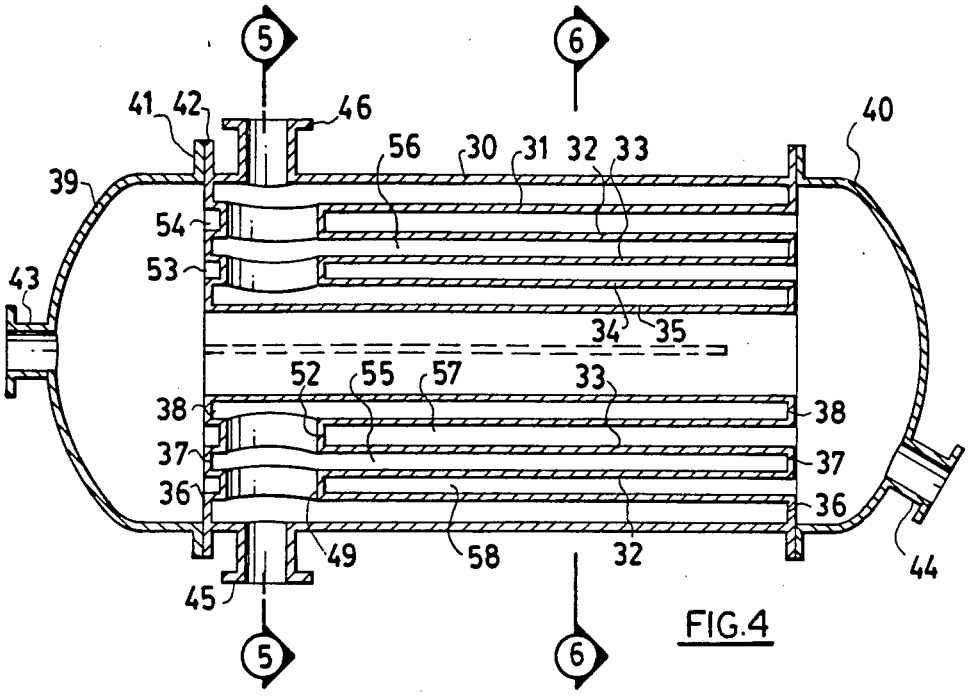
FIG. 4 is a longitudinal cross sectional view of a second emjbodiment of heat exchkanger according to the invention.
Figure 5:
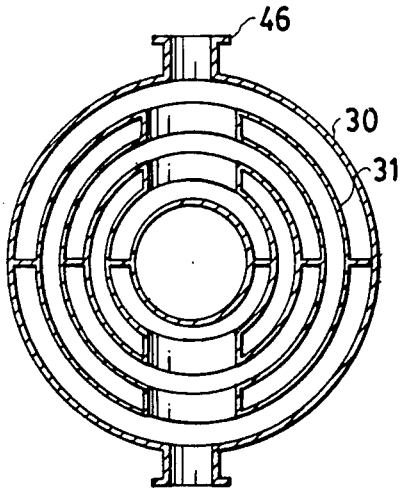
FIG. 5 is a cross sectional view along the lines 5—5 of FIG. 4.
Figure 6:
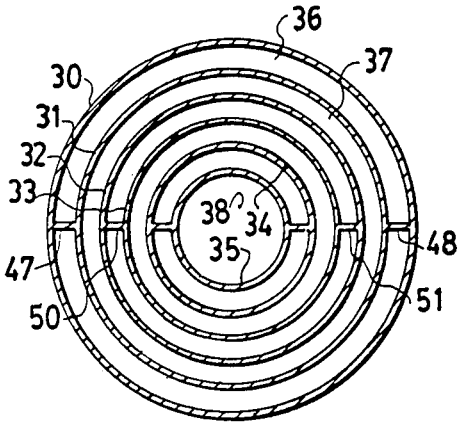
FIG. 6 is a cross sectional view along the lines 6—6 of FIG. 4.

Turning now to the embodiment shown in FIGS. 4, 5 and 6, there is provided a heat exchanger comprising a plurality of tubes 30, 31, 32, 33, 34 and 35 arranged co-extensively and co-axially such that the innermost tube 35 defines a cylindrical channel through the interior thereof and an annular channel between the exterior thereof and the interior of the next adjacent outer tube 34. Similarly, annular channels are defined between each tube and the next adjacent outer tube as best shown in FIG. 6. The tubes are interconnected by annular closure member 36 which is welded to the inside and outside edges of alternate tubes as shown in FIG. 4. Thus, the annular closure member 36 is welded between the tube 30 and the tube 31 to close off the ends of the annular channel or chamber defined therebetween. Similarly, closure members 37 and 38 are welded between the tubes 33, 32 and 35, 34 as will be apparent from FIG. 4.

In between the closure members 36, 37, 38, the annular channels are left open so that they can be placed in communication with manifolds defined by end caps 39, 40 on respective ends of the tubes 30. Thus each of the end caps carries suitable flanges 41 for cooperation with flanges 42 on the outer edges of the tube 30 so the whole can be bolted together to form a complete heat exchanger.

The end cap 39 carries an inlet 43 for first fluid and then end cap 40 carries an outlet 44 for second fluid which is preferably hot flue gases or steam.

A manifold for supply cool or cold water to the channels alternate to those through which the hot gases are passing, comprises an inlet 45 and an outlet 46 in the form of short duct portions welded to the outer surface of the tube 30. Thus, water can enter the annular passage or chamber defined between the tubes 30 and 31, can pass therearound and exit from the outlet 46. To ensure that the fluid passes along the annular channel, radial fins 47, 48 are positoned between the tubes in a similar manner to the fins of the first embodiment and confine the fluid to pass along the channel to an end of the fins 47, 48 adjacent the end closure member 36 thus forming an upper and lower channel portion as best shown in FIG. 6.

In addition, fluid is communicated form the inlet 45 through a duct portion 49 welded to the inner surface of the tube 31 and to the outer surface of the tube 32. This acts to communicate fluid into the channel defined between the tubes 32 and 33 for passage therealong under control of radial fins 50, 51 similar to that previously described.

Similarly, further duct portion 52, 53 and 54 complete the manifold from the inlet 45 through to the outlet 46 and ensure communication of the fluid to and from each of tha annular channels in turn.

In this way, cold water passing, for example, through the channel indicated at 55 outwardly toward the end closure member and back through the channel indicated at 56, is acted upon by hot gases from both the inner surface of the channel and from the outer surface of the channel passing through the alternate annular channels indicated at 57 and 58 respectively.

from FIGS. 4 and 5, it will be appreciated that the shape of the duct portions 49, 52, 52, 54 is each in the form of a short ring, the upper and lower surfaces of which are curved around the tune for cooperation with a circular opening in the respective tube. Such an arrangement can be manufactured by welding the duct portions initially to the inner tube following which the respective outer tube is slid into position and then welded in place onto teh respective ducts portions.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A heat exchanger for exchanging heat between a first fluid and a second fluid, comprising a housing, means defining in said housing a first inlet and a first outlet for the first fluid and a second fluid inlet and a second outlet for the second fluid, an heat exchange core through which said fluids are arranged to pass in heat exchanging, fluid impervious relationship, said core comprising a plurality of first tubes, a plurality of second tubes, means mounting each of the first tubes inside a respective one of the second tubes and arranged so as to define for each first and second tube a first channel through said first tube having as an outer surface the inner surface of said first tube, a second channel having as an outer surface the inner surface of the second tube and as an inner surface the outer surface of the first tube and a third channel having as an inner surface the outer surface of the second tube, first manifold means for communicating said first fluid from said first inlet through said first and third channels to said first outlet and second manifold means for communicating said second fluid from said second inlet through said second channel to said second outlet, end closure means for closing said second channel at one end of said first and second tubes and baffel means dividing said second channel longitudinally, said baffle means being spaced from said end closure means whereby said second fluid travels along said second channel toward said end closure means on one side of said baffle means and returns along said second channel from said end closure means along an opposed side of said baffle means.

2. The invention according to claim 1 wherein said baffle means comprises radial fins extending from the outer surface of the first tube to the inner surface of the second tube.

3. The invention according to claim 2 wherein the radial fins are welded to the outer surface of the first tube.

4. The invention according to claim 1
wherein the baffle means comprises a pair of fins extending radially of the first tube and arranged at 180° spacing.

5. A heat exchanger for exchanging heat between the first fluid and the second fluid comprising a housing, means defining in said housing a first inlet and a first outlet for the first fluid and a second inlet and a second outlet for the second fluid, a heat exchange core through which said fluids are arranged to pass in heat exhanging, fluid impervious relationship, said core comprising a first tube sheet, a plurality of first tubes attached in spaced arrangement thereon and extending outwardly to one side of said first tube sheet, a second tube sheet, a plurality of second tubes attached in spaced arrangement theron and extending joutwardly to one side of said second tube sheet, means mounting said first and second tube sheets in spaced relation and arranged such that each of said first tubes extends into a respective one of the second tubes, a first maifold means arranged on a opp osed side of said first tube sheet whereby to communicate fluid from said first inlet through said first tubes, second manifold means arranged on said one side of said first tube sheet and on an opposed side of said second tube sheet whereby to communicate fluid from said second inlet through an annular space defined between said second tubes and said first tubes, end closure means for closing the annular area between the second and first tubes and baffle means extending longitudinally between said second and first tubes for dividing said annual channel into first and second portions whereby fluid from said second inlet entering said annular channel travels along one portion towards said end closure means and then teturns from said end closure means along said second portion.

6. The invention according to claim 5 wherein said first tubes are arranged such that fluid existing therefrom engages an outer surface of said second tubes.

7. The invention according to claim 5 wherein said second manifold means is divided such that fluid from said second inlet passes throuugh each of a plurality of said second tubes in turn.

8. The invention according to claim 5
wherein the second tubes are mounted within the housings so that fluid escaping form the first tube passes into the housing and around thee second tubes to said first outlet.

9. The invention according to claim 5
wherein the first manifold means includes an end cap covering said first tube sheet and wherein said second manifold means includes a collar surrounding the first and second tube sheets and positioned therebetween, said collar being clamped between said first and second tube sheets by said end cap and said housing.

* * * * *